US009095487B2

(12) United States Patent
Skeen et al.

(10) Patent No.: US 9,095,487 B2
(45) Date of Patent: Aug. 4, 2015

(54) CAP PANEL SHELF

(71) Applicant: MATTHEWS RESOURCES, INC., Wilmington, DE (US)

(72) Inventors: Philip Brian Skeen, Smiths, AL (US); Yves Joseph Allard, Hellam, PA (US)

(73) Assignee: Matthews Resources, Inc., Wilmington, DE (US)

( * ) Notice: Subject to any disclaimer, the term of this patent is extended or adjusted under 35 U.S.C. 154(b) by 0 days.

(21) Appl. No.: 14/216,799

(22) Filed: Mar. 17, 2014

(65) Prior Publication Data

US 2014/0259575 A1 Sep. 18, 2014

Related U.S. Application Data

(60) Provisional application No. 61/790,752, filed on Mar. 15, 2013.

(51) Int. Cl.
*A61G 17/04* (2006.01)
*A61G 17/02* (2006.01)

(52) U.S. Cl.
CPC ..... *A61G 17/04* (2013.01); *A61G 17/02* (2013.01); *Y10T 29/49947* (2015.01)

(58) Field of Classification Search
CPC .. A61G 17/04; A61G 17/02; Y10T 29/49947; B65D 51/28; A47B 46/00; A47B 96/024; A47B 96/028; A47B 96/066; A47B 96/07
USPC ..... 27/2, 14, 16, 18, 19; D99/1, 2, 9, 10; 220/521–522; 108/25–26; 190/5; 312/313; 29/525.01
See application file for complete search history.

(56) References Cited

U.S. PATENT DOCUMENTS

| | | | | |
|---|---|---|---|---|
| 4,457,054 | A * | 7/1984 | Craft et al. | 27/1 |
| 5,611,124 | A * | 3/1997 | Biondo et al. | 27/2 |
| 6,324,736 | B1 * | 12/2001 | Atrio | 27/2 |
| 6,715,190 | B2 * | 4/2004 | Groemminger et al. | 27/19 |
| 6,836,936 | B1 * | 1/2005 | Biondo et al. | 27/2 |
| 7,159,287 | B2 * | 1/2007 | Parker et al. | 27/19 |
| 7,249,402 | B2 * | 7/2007 | Davis et al. | 27/18 |
| 7,316,053 | B2 * | 1/2008 | Dennis et al. | 27/2 |
| 7,392,574 | B2 * | 7/2008 | Bovard et al. | 27/14 |
| 7,584,529 | B1 * | 9/2009 | Parker | 27/19 |
| 7,657,981 | B2 * | 2/2010 | Parker | 27/19 |
| 7,661,179 | B2 * | 2/2010 | Parker et al. | 27/2 |

* cited by examiner

*Primary Examiner* — William Miller
(74) *Attorney, Agent, or Firm* — Pepper Hamilton LLP

(57) ABSTRACT

A casket may include a casket shell, at least one casket cap pivotally mounted on the casket shell, a cap panel inserted in a cavity formed by a bottom surface of the at least one casket cap, a plurality of puffing members attached to the edges of the cap panel, and a cap panel shelf mounted on the bottom surface of the casket cap. The cap panel shelf may be mounted on the casket cap by using wooden dowels. The cap panel shelf may be mounted on the casket cap by using mounting brackets positioned in between a puffing member on the bottom edge of the cap panel and the cap panel. A hinged support may be fastened to the bottom surface of the cap panel shelf to retain the cap panel shelf at a desired position.

14 Claims, 7 Drawing Sheets

CAP PANEL SHELF

CROSS REFERENCE TO RELATED APPLICATIONS

This application claims the benefit of U.S. Provisional Application No. 61/790,752 filed on Mar. 15, 2013, the contents of which are incorporated by reference in their entirety as if fully set forth herein.

TECHNICAL FIELD

This disclosure relates generally to caskets, and more particularly, to a shelf for a casket cap or lid.

BACKGROUND

It is a common wish among family members and friends to display personal items and memorabilia of a deceased loved one during a funeral viewing. These items help family members and friends to remember the deceased and provide special memories. A typical option for displaying personal items includes using a poster board and easel to display pictures of the deceased. However, this option limits the size and shape of items that may be displayed. For example, items such as a picture frame or book cannot be properly mounted on the poster board, leaving family members with no place to easily display such items of the deceased within the casket.

Conventional casket display options for family members include small removable shelves or small shelves configured to fold down when not in use. For example, one typical option for family members is to use a small removable shelf that includes a flat, smooth shelf portion and a retaining portion for inserting the shelf between a casket cap panel and a puffing member. These removable shelves are generally small and can only hold one or two small objects during use. Such small removable shelves generally include retaining portions configured to press against the cap panel when an item placed on the shelf puts a downward force on the shelf. Another typical option includes shelf arrangements that are hingedly or pivotally mounted on a casket cap panel. When the casket cap is opened during a funeral viewing, the shelf pivots downward from the casket cap to provide a level surface to place items thereon. Such pivotally mounted shelf arrangements may pivot about a bottom edge of the shelf and can be stored in the cap panel when not in use. However, conventional casket display options do not provide a display shelf that is strong enough to display the number and types of items desired by family members and other loved ones of the deceased and that are also easily mounted and/or removable from the casket when not in use, such as when closing the casket. As such, there is a need for a robust casket cap shelf that can be easily mounted and removed on a casket cap.

SUMMARY

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

In an embodiment, a casket may include a casket shell, at least one casket cap pivotally attached to the casket shell, and a cap panel arranged in a cavity formed by a bottom surface of the at least one casket cap. The casket may also include a cap panel shelf having at least two dowels attached thereto, the cap panel shelf being attached to the bottom surface of the casket cap, and at least two mounting brackets attached to the bottom surface of the casket cap. Each mounting bracket may include at least one dowel hole for receiving the corresponding dowels of the cap panel shelf.

In an embodiment, a casket may include a casket shell, at least one casket cap pivotally attached to the casket shell, a cap panel arranged in a cavity formed by a bottom surface of the at least one casket cap, and a cap panel shelf mounted on the bottom surface of the casket cap via at least two retaining brackets and a hinged support fastened to the bottom surface of the cap panel shelf.

In an embodiment, a method of manufacturing a casket may include forming a casket shell, attaching at least one casket cap to the casket shell, and arranging a cap panel within a cavity formed by a bottom surface of the at least one casket cap. A cap panel shelf may be provided that has at least two dowels attached thereto. The cap panel shelf may be configured to be attached to the bottom surface of the casket cap. At least two mounting brackets may be provided that are configured to be attached to the bottom surface of the casket cap. Each mounting bracket may include at least one dowel hole for receiving the corresponding dowels of the cap panel shelf.

DETAILED DESCRIPTION

For purposes of the description hereinafter, spatial orientation terms, as used, shall relate to the referenced embodiment as it is oriented in the accompanying drawings, figures, or otherwise described in the following detailed description. However, it is to be understood that the embodiments described hereinafter may assume many alternative variations and configurations. It is also to be understood that the specific components, devices, features, and operational sequences illustrated in the accompanying drawing, figures, or otherwise described herein are simply exemplary and should not be considered as limiting.

The described embodiments generally relate to a casket having a cap panel shelf arranged within a cap thereof. In some embodiments, a casket may include a cap panel with a shelf. The casket may include a casket shell, a casket cap pivotally mounted on the casket shell, a cap panel inserted in a cavity formed by a bottom surface of the casket cap, a plurality of puffing members attached to the edges of the cap panel, and a cap panel shelf mounted to the bottom surface of the casket cap. The cap panel shelf may include at least two dowels attached to a bottom surface of the cap panel shelf. At least two mounting brackets may be mounted on the bottom surface of the casket cap. Each mounting bracket may include at least one dowel hole for receiving the dowels of the cap panel shelf.

In some embodiments, each dowel may be press fit or otherwise secured, such as with an adhesive, into a corresponding hole on a peripheral side of the cap panel shelf. In some embodiments, each dowel may be press fit or secured with an adhesive into the dowel hole of the corresponding mounting bracket.

In some embodiments, a casket may include a casket shell, at least one casket cap pivotally mounted on the casket shell, a cap panel inserted in a cavity formed by a bottom surface of the at least one casket cap, a plurality of puffing members attached to the edges of the cap panel, and a cap panel shelf mounted on the bottom surface of the casket cap. The cap panel shelf may include at least two retaining brackets and a hinged support fastened to the bottom surface of the cap panel shelf. The retaining brackets and the hinged support may be fastened on opposing sides of the bottom surface of the cap panel shelf. The retaining brackets may be inserted in between a puffing member on a bottom edge of the cap panel and the cap panel. The hinged support may include one member fastened to the bottom surface of the cap panel shelf and one member fastened to the puffing member.

Figure 1:
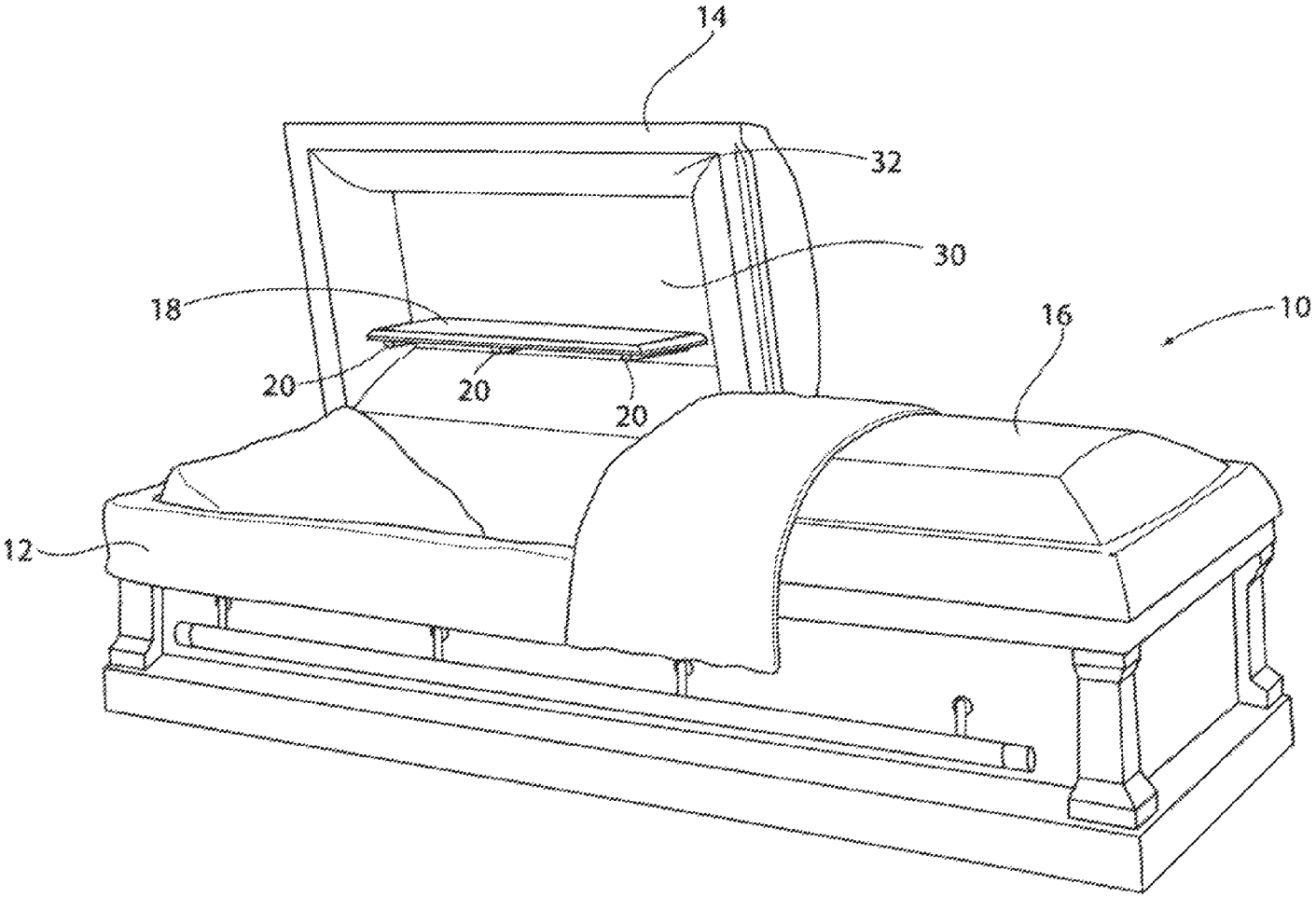
FIG. 1 depicts a perspective view of an illustrative casket and cap panel shelf according to some embodiments.
Figure 2:
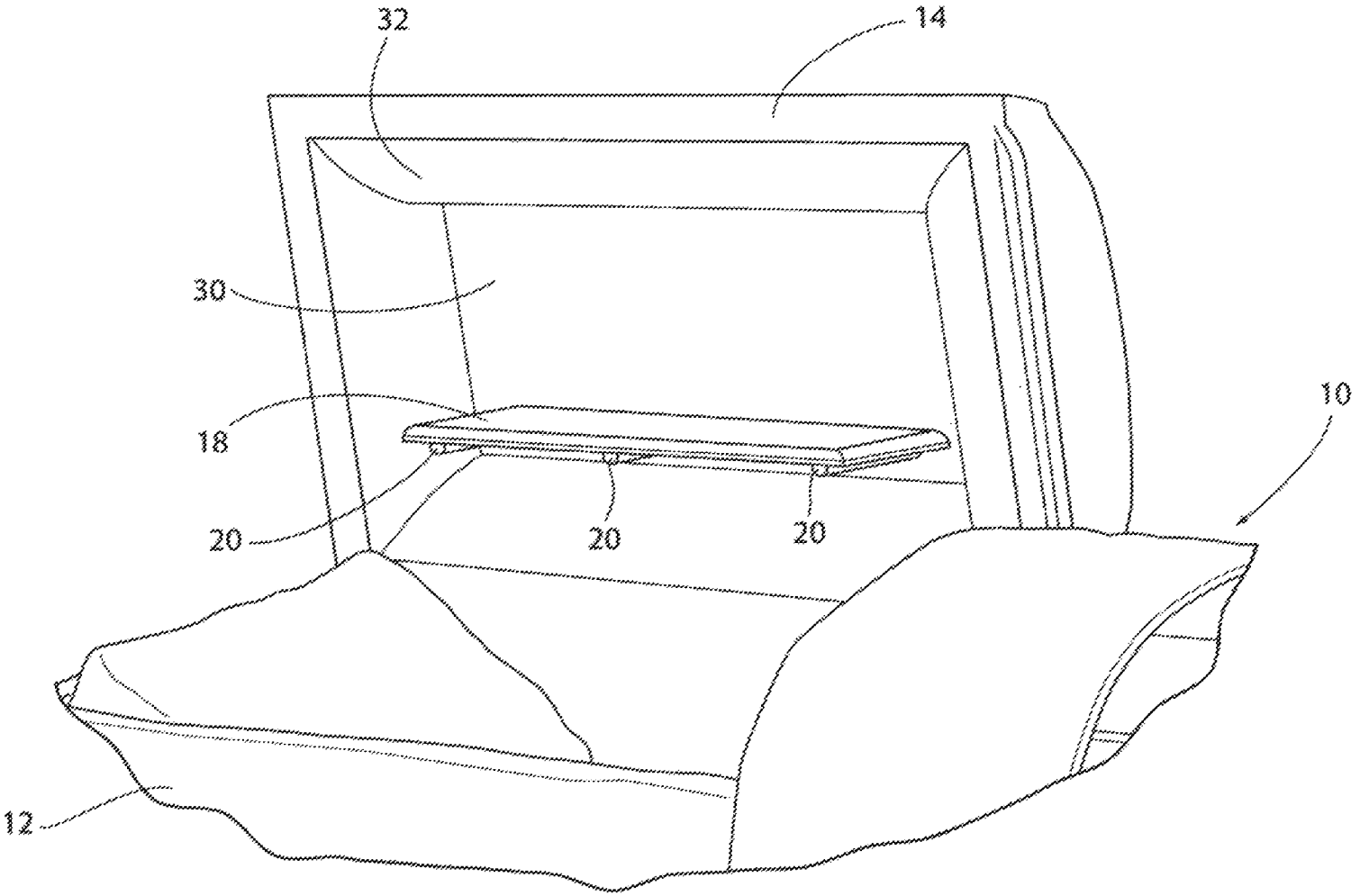
FIG. 2 depicts an isolated view of an illustrative casket cap and the cap panel shelf according to some embodiments.
Figure 3:
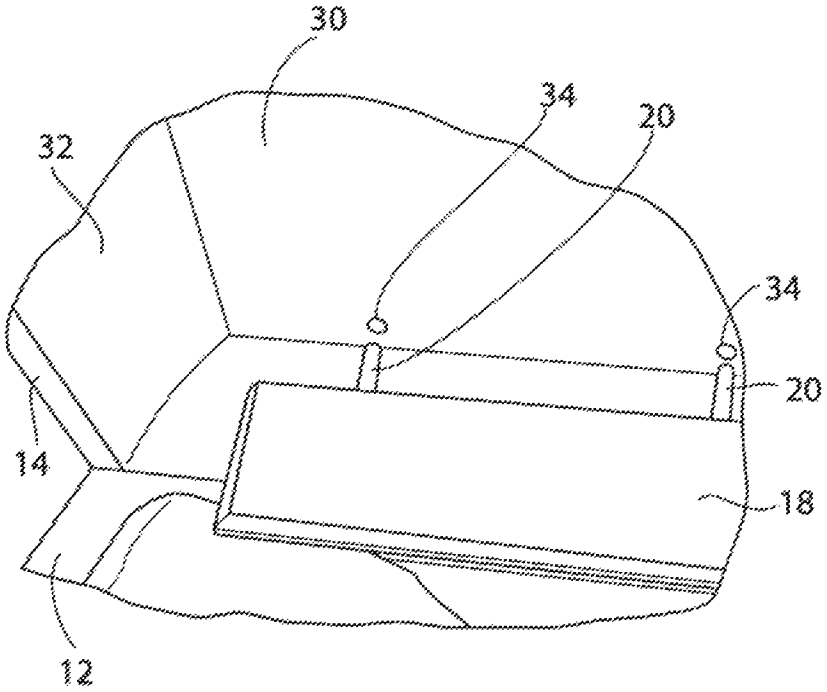
FIG. 3 depicts an isolated view of an illustrative cap panel shelf being inserted into a cap panel according to some embodiments.

FIGS. 1-3, generally depict a casket 10 with a cap panel shelf 18 according to some embodiments. The casket 10 may include a shell 12 having a rectangular or substantially rectangular shape. One or more caps or lids 14, 16 may be pivotally attached to the shell 12. The caps 14, 16 may be pivotally attached to the shell 12 by hinges and/or structures configured to provide a pivotable and/or rotatable attachment to a surface as known by those having ordinary skill in the art. The casket 10 may include two caps, for example, a head end cap 14 and a foot end cap 16. In some embodiments, the casket 10 may include one continuous cap that extends the full longitudinal length of the shell 12. Whenever the head cap 14 is open, a shelf 18 may be removably mounted on an underside surface of the head cap 14. In some embodiments, each cap 14, 16 may include a shelf 18 positioned on each underside surface of the caps 14, 16.

As shown in FIGS. 2 and 3, the shelf 18 may be removably mounted to the head cap 14 through the use of dowels 20. The shelf 18 may have a rectangular or substantially rectangular shape. However, embodiments are not so limited. Indeed, the shelf 18 may have any shape or size capable of operating according to some embodiments. The shelf 18 may include a continuous, flat surface that extends for at least a portion of the length of the head cap 14. A plurality of dowels 20 may be attached to the shelf 18. At least two dowels 20 may be used to hold both longitudinal ends of the shelf 18. However, more than two dowels 20 may be used along the longitudinal axis of the shelf 18 to mount the shelf to the cap 14. The dowels 20 may be made from various materials, including, without limitation, wood, plastic, metal, or any combination thereof. The dowels 20 may be of a cylindrical or substantially cylindrical shape. In some embodiments, the dowels 20 may include pins of varying size and shape, including, but not limited to, triangular or square-shaped pins. As shown in FIG. 5B, the shelf 18 may include shelf holes 36 on at least one of its peripheral sides. The shelf holes 36 may be adapted to receive the dowels 20, which may be fastened therein using various methods, including, but not limited to, in a press fit, using adhesives, fasteners, welding, or any combination thereof. The position of the shelf holes 36 may correspond to the position of the dowel holes 28 (see FIG. 4) on the mounting brackets 22, for example, to facilitate the leveling of the shelf 18 and the proper positioning of the dowels 20 in relation to the dowel holes 28 and the shelf holes 36. The shelf 18 may include various numbers of shelf holes 36, including 1 shelf hole, 2 shelf holes, 3 shelf holes, 5 shelf holes, 10 shelf holes, and values and ranges between any two of these values (including endpoints). The number of shelf holes 36 may be selected to, among other things, enable additional dowels 20 to hold up the shelf 18.

Figure 4:
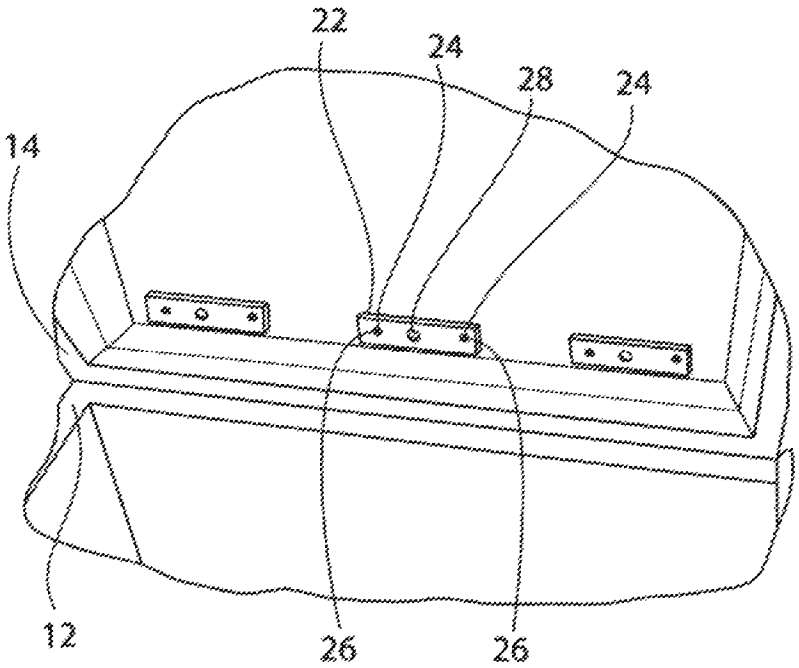
FIG. 4 depicts an isolated view of an illustrative mounting bracket coupled to a casket cap according to some embodiments.
Figure 5A:
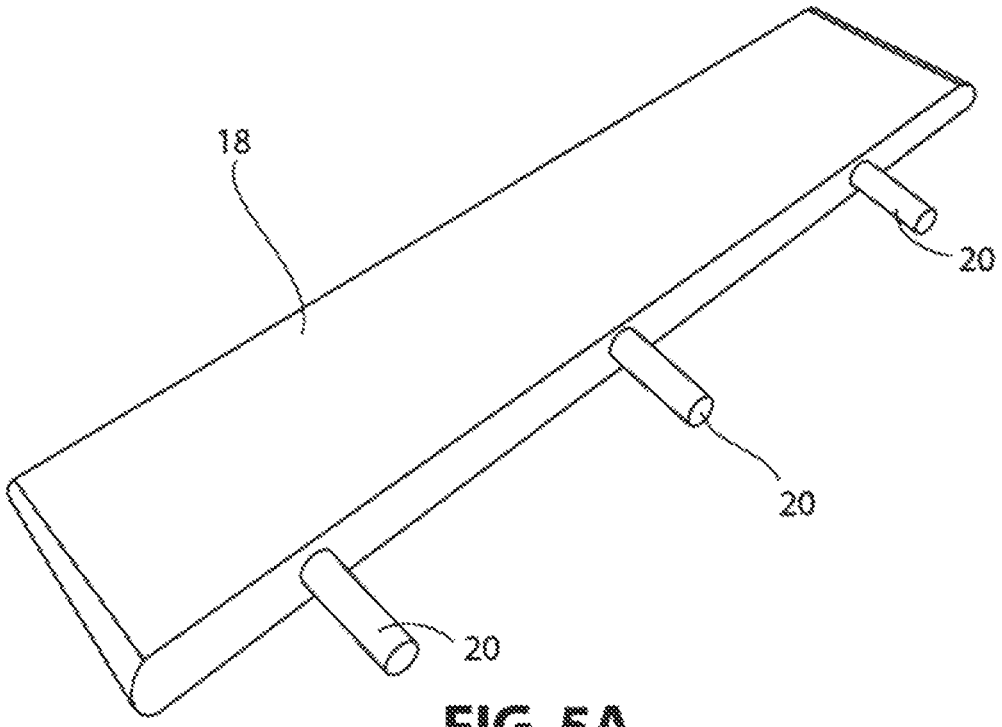
FIGS. 5A and 5B depict isolated views of an illustrative cap panel shelf and corresponding holes adapted for receiving dowels according to some embodiments.
Figure 5B:
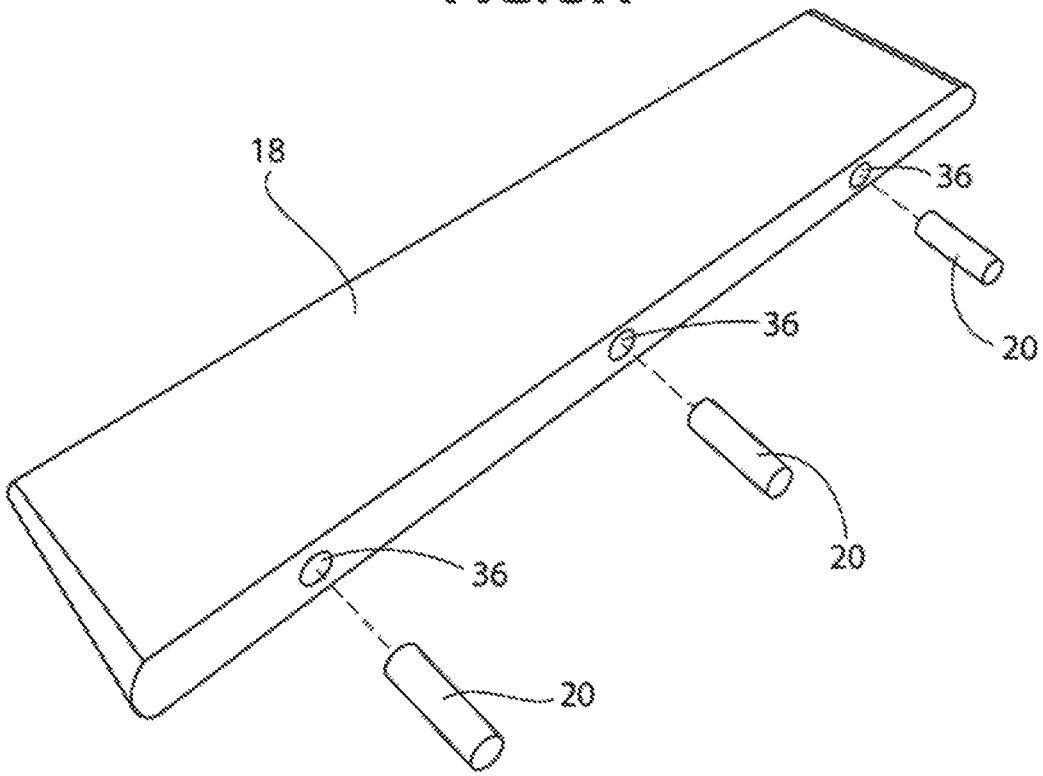

As shown in FIG. 4, mounting brackets 22 may be positioned on a bottom surface of the cap 14 via suitable fasteners 26. In some embodiments, each mounting bracket 22 may include at least two fastener holes 24 used to mount each mounting bracket onto the cap 14 via the fasteners 26. The fastener holes 24 may be positioned on opposing lateral sides of each mounting bracket 22. The fastener holes 24 may also be positioned in different arrangements, including at the center of each mounting bracket 22. A dowel hole 28 may be positioned in each mounting bracket 22. For example, the dowel hole 28 may be positioned at the center of each mounting bracket 22. The dowel hole 28 may have a diameter slightly larger than the dowel 20 to allow the dowel hole to receive the dowel in a press fit relationship. In some embodiments, the dowel 20 may be secured in the dowel hole 28 by using an adhesive, such as glue, to permanently mount the shelf 18 on the bottom surface of the cap 14. In some embodiments, at least two mounting brackets 22 may be fastened to the bottom surface of the cap 14 to receive the dowels 20 attached to the bottom surface of the shelf 18. The centers of the dowel holes 28 of each mounting bracket 22 may be positioned a distance apart from each other equal to the distance between the dowels 20 on the shelf 18. The centers of the dowel holes 28 may also be positioned at an equal height to one another on the bottom surface of the cap 14.

The cap 14 may be opened by an individual, thereby exposing the interior of the casket 10. The individual may line up the dowels 20 of the shelf 18 with the dowel holes 28 of each mounting bracket 22 and may insert the dowels into the dowel holes. The individual may press fit the dowels 20 into the dowel holes 28, thereby allowing the individual to remove the shelf 18 upon the closing of the cap 14. In some embodiments, the individual may apply an adhesive to the inside of the dowel holes 28 before inserting the dowels 20, for example, to position the shelf 18 as a permanent fixture on the bottom surface of the cap 14.

A cap panel 30 may be positioned in a cavity formed by the bottom surface of the cap 14. The cap panel 30 may be of a rectangular or substantially rectangular shape, for example, corresponding to the shape of the cap 14 puffing members 32 attached to each edge of the cap panel 30. In some embodiments, the puffing members 32 may be fastened, for example, via staples, to a back surface of the cap panel 30. The cap panel 30 may be inserted into the cap 14, with each mounting bracket 22 positioned in between the cap panel and the cap. The cap panel 30 may include holes 34 that correspond in size and position to the dowel holes 28 of each mounting bracket 22, thereby allowing the dowels 20 of the shelf 18 to pass through the cap panel and into the dowel holes.

Figure 6:
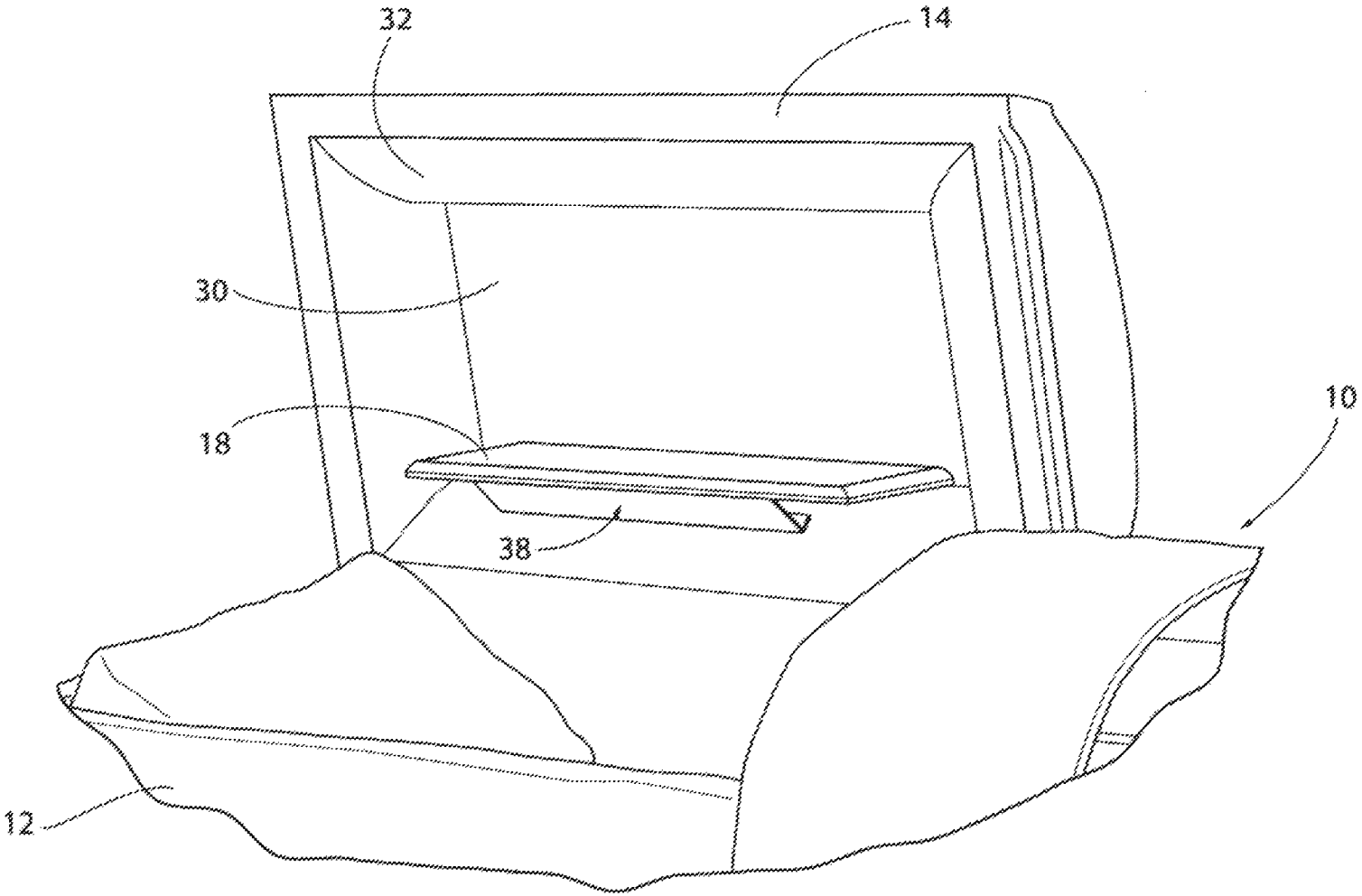
FIG. 6 depicts an isolated view of an illustrative casket cap and cap panel shelf with a hinged support according to some embodiments.
Figure 7:
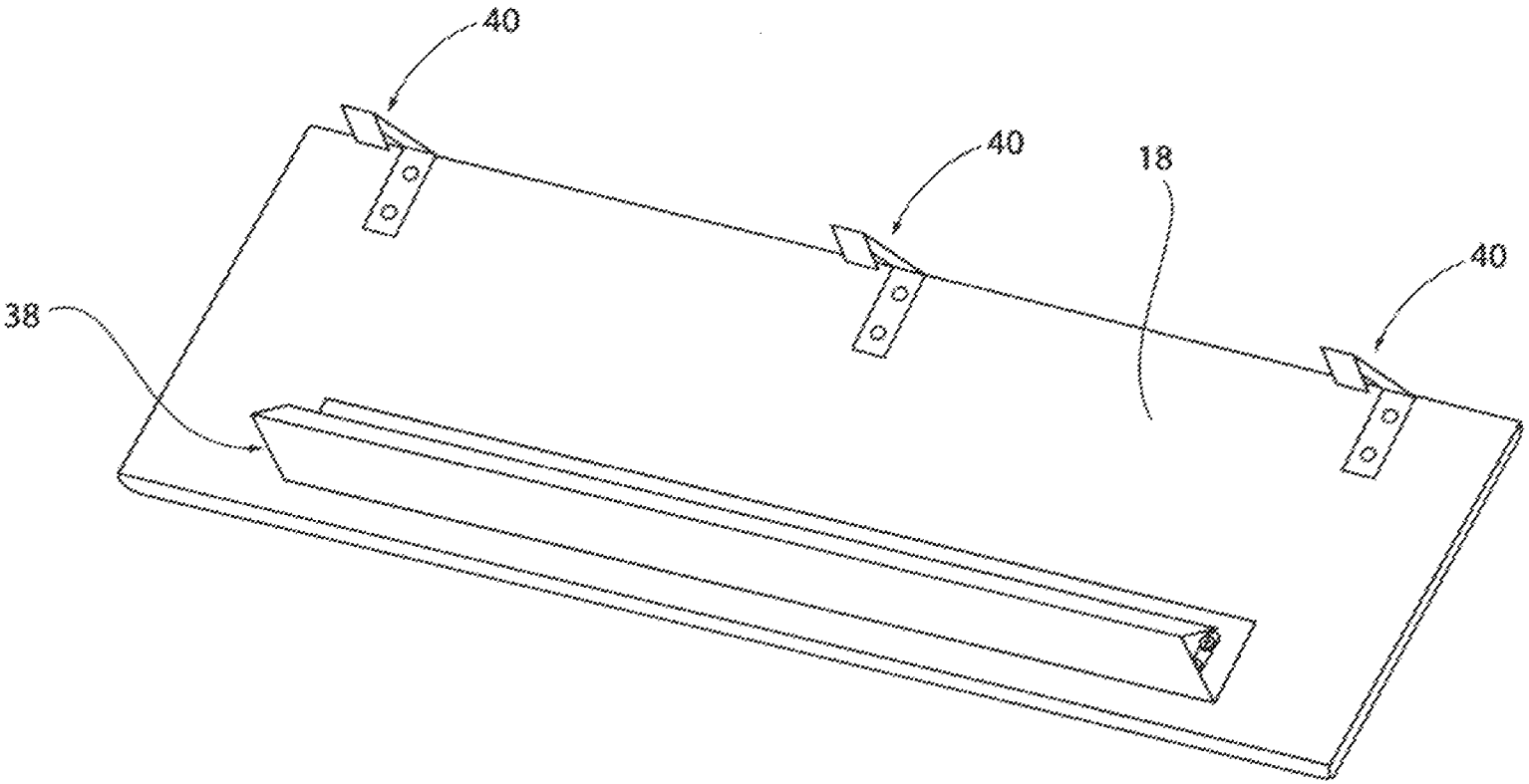
FIG. 7 depicts a bottom view of an illustrative cap panel shelf according to some embodiments.
Figure 8:
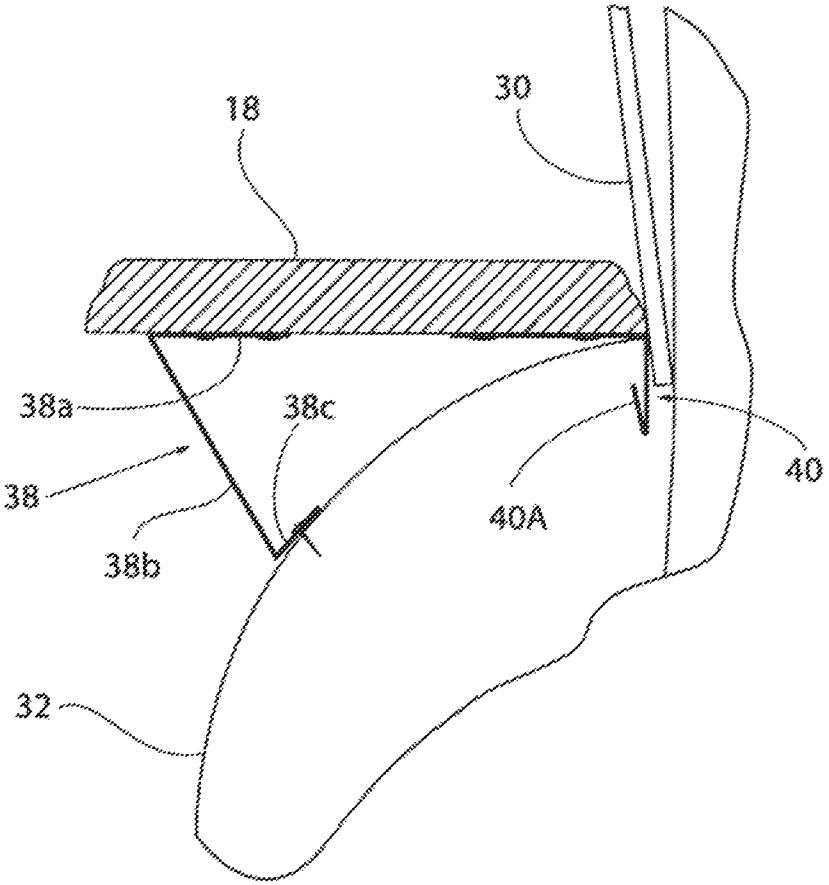
FIG. 8 depicts a side view of an illustrative casket cap and cap panel shelf according to some embodiments.

As shown in FIGS. 6-8, the shelf 18 may be mounted on the head cap 14 using at least two retaining brackets 40 and a hinged support member 38. Each retaining bracket 40 may be coupled to the bottom surface of the shelf 18 via suitable fasteners. The retaining brackets 40 may be spaced at various distances from each other, such as at an equal distance from one another. The retaining brackets 40 may be have various shapes, such as an L-shape with one arm including a protruding member 40*a* positioned at an angle to the arm. The shelf 18 may be mounted on the head cap 14 by sliding the retaining brackets 40 in between a puffing member 32 on the bottom edge of the cap panel 30 and the cap panel. The protruding member 40*a* may keep the retaining brackets 40 in between the puffing member 32 and the cap panel 30. As additional objects and items may be placed on the shelf 18, the protruding member 40*a* may act against the added weight from the shelf 18, thereby keeping the shelf at a level position.

The shelf 18 may also include a hinged support 38 coupled to the bottom surface of the shelf. The hinged support 38 may include an attachment member 38*a* that may be fastened to the bottom surface of the shelf 18, a connecting member 38*b*, and a retaining member 38*c* that may be used to fasten the hinged support to the puffing member 32. The attachment member 38*a*, the connecting member 38*b*, and/or the retaining member 38*c* may be integral parts of the hinged support 38. The attachment member 38*a* may be positioned parallel to the shelf 18. The connecting member 38*b* may extend at an angle from one end of the attachment member 38*a* to one end of the retaining member 38*c*. The retaining member 38*c* may extend upwardly at an angle toward the attachment member 38*a* and may be used to fasten the hinged support 38 to the puffing member 32. When an individual wishes to use the shelf 18, the retaining brackets 40 may be inserted in between the puffing member 32 and the cap panel 30. The individual may then fasten the hinged support 38 to the puffing member 32 via the retaining member 38*c*.

While an embodiment of a cap panel shelf for a casket is shown in the accompanying figures and described hereinabove in detail, other embodiments will be apparent to, and readily made by, those skilled in the art without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are to be embraced within their scope.

In the above detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (for example, bodies of the appended claims) are generally intended as "open" terms (for example, the term "including" should be interpreted as "including but not limited to," the term "having" should be interpreted as "having at least," the term "includes" should be interpreted as "includes but is not limited to"). While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (for example, "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (for example), the bare recitation of "two recitations," without other modifiers, means at least two recitations, or two or more recitations). Furthermore, in those instances where a convention analogous to "at least one of A, B, and C, et cetera" is used, in general such a construction is intended in the sense one having skill in the art would understand the convention (for example, "a system having at least one of A, B, and C" would include but not be limited to systems that have A alone, B alone, C alone, A and B together, A and C together, B and C together, and/or A, B, and C together, et cetera). In those instances where a convention analogous to "at least one of A, B, or C, et cetera" is used, in general such a construction is intended in the sense one having skill in the art would understand the convention (for example, "a system having at least one of A, B, or C" would include but not be limited to systems that have A alone, B alone, C alone, A and B together, A and C together, B and C together, and/or A, B, and C together, et cetera). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or, "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, or the like. As a non-limiting example, each range discussed herein can be readily broken down into a lower third, a middle third, and an upper third. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A casket, comprising:

a casket shell;

at least one casket cap pivotally coupled to the casket shell;

a cap panel arranged in a cavity formed by a bottom surface of the at least one casket cap;

a cap panel shelf having at least two dowels attached thereto, the cap panel shelf being coupled to the bottom surface of the casket cap; and at least two mounting brackets coupled to the bottom surface of the casket cap, wherein each mounting bracket comprises at least one dowel hole for receiving the corresponding dowels of the cap panel shelf.

2. The casket of claim 1, wherein each dowel is press fit or secured with an adhesive into a corresponding hole on a peripheral side of the cap panel shelf.

3. The casket of claim 2, wherein each dowel is press fit or secured with adhesive into the dowel hole of the corresponding mounting bracket.

4. The casket of claim 1, wherein the at least two dowels are formed from at least one of wood, plastic, metal, or a combination thereof.

5. The casket of claim 1, further comprising at least one puffing member attached to an edge of the cap panel.

6. The casket of claim 5, further comprising a hinged support member having a first end coupled to a bottom surface of the shelf and a second end coupled to the at least one puffing member.

7. A casket, comprising:

a casket shell;

at least one casket cap pivotally coupled to the casket shell;

a cap panel arranged in a cavity formed by a bottom surface of the at least one casket cap; and a cap panel shelf coupled to the bottom surface of the casket cap via at least two retaining brackets and a hinged support coupled to the bottom surface of the cap panel shelf.

8. The casket of claim 7, wherein the retaining brackets and the hinged support are coupled to opposing sides of the bottom surface of the cap panel shelf.

9. The casket of claim 8, wherein the retaining brackets are inserted in between a puffing member on a bottom edge of the cap panel and the cap panel.

10. The casket of claim 9, where the hinged support comprises one member coupled to the bottom surface of the cap panel shelf and one member coupled to the puffing member.

11. A method of manufacturing a casket, the method comprising forming a casket shell;

coupling at least one casket cap to the casket shell;

arranging a cap panel within a cavity formed by a bottom surface of the at least one casket cap;

providing a cap panel shelf having at least two dowels attached thereto, the cap panel shelf being configured to be coupled to the bottom surface of the casket cap; and providing at least two mounting brackets configured to be coupled to the bottom surface of the casket cap, wherein each mounting bracket comprises at least one dowel hole for receiving the corresponding dowels of the cap panel shelf.

12. The method of claim 11, wherein the at least two dowels are formed from at least one of wood, plastic, metal, or a combination thereof.

13. The method of claim 11, further comprising at least one puffing member attached to an edge of the cap panel.

14. The method of claim 13, further comprising a hinged support member having a first end coupled to a bottom surface of the shelf and a second end coupled to the at least one puffing member.

* * * * *